United States Patent [19]

Munting

[11] 3,966,867

[45] June 29, 1976

[54] MANUFACTURE OF UNIQUE POLYETHYLENE TEREPHTHALATE FIBER

[75] Inventor: Johannes Pieter Munting, Emmen, Netherlands

[73] Assignee: Akzona Incorporated, Asheville, N.C.

[22] Filed: Mar. 13, 1974

[21] Appl. No.: 450,776

Related U.S. Application Data

[62] Division of Ser. No. 187,521, Oct. 7, 1971, Pat. No. 3,838,561, which is a division of Ser. No. 852,915, Aug. 25, 1969, Pat. No. 3,650,879.

[30] Foreign Application Priority Data

Aug. 31, 1968 Netherlands ..... 6812442

[52] U.S. Cl. ..... 264/210 F; 264/290 T

[51] Int. Cl.[2] ..... B29C 17/02; D01D 5/10; D01D 5/16

[58] Field of Search ..... 264/290 N, 290 T, 210 F, 264/DIG. 73, 242 RE

[56] References Cited

UNITED STATES PATENTS

| | | | |
|---|---|---|---|
| 2,556,295 | 6/1951 | Pace, Jr. | 264/78 |
| 3,216,187 | 11/1965 | Chantry | 264/210 F |
| 3,413,797 | 12/1968 | Chapman | 57/140 |
| 3,452,132 | 6/1969 | Pitzl | 264/210 F |
| 3,564,835 | 2/1971 | Keefe, Jr. et al. | 264/290 N |

*Primary Examiner*—Robert F. White
*Assistant Examiner*—James B. Lowe
*Attorney, Agent, or Firm*—Craig & Antonelli

[57] ABSTRACT

Polyethylene Terephthalate fiber having a relative viscosity of 1.50 to 1.70 is drawn in two stages. In the first stage the fiber is drawn at a draw ratio of from about 3.8 to 4.2 at a temperature of about 70°C to about 100°C. In the second stage the fiber is drawn in superheated steam at a temperature of about 210°C to 250°C at a draw ratio such that the total draw ratio for the two stages is from about 5.6 to 6.0. The fiber produced has a tenacity of at least about 7.5 grams per denier, an elongation at break of at least about 9%, an elongation of not more than about 5% under a load of 5 grams per denier and a shrinkage of less than 4% when kept under a tension of 0.05 grams per denier for 4 minutes at about 160°C. The fiber is especially suitable for reinforcing bitumen-containing materials.

3 Claims, No Drawings

MANUFACTURE OF UNIQUE POLYETHYLENE TEREPHTHALATE FIBER

CROSS REFERENCE TO RELATED APPLICATIONS

This application is a division of application Ser. No. 187,521, filed Oct. 7, 1971, now U.S. Pat. No. 3,838,561 which application is in turn a division of application Ser. No. 852,915, filed Aug. 25, 1969, now U.S. Pat. No. 3,650,879.

This invention relates to reinforcing fibrillary material, e.g. fibers, threads, yarns or like thread-like products, of a polymer substantially made up of ethylene terephthalate units and more particularly to polyethylene terephthalate fibers having a combination of properties especially suitable for the reinforcing of bitumen-containing materials, to a process for producing such fibers and products reinforced thereby.

The term "fibers," as used throughout this specification is meant to include continuous monofilaments, non-twisted or entangled multifilament yarns, staple yarns and spun yarns. Such fibers may be used to form woven fabrics, knitted fabrics, fibrous webs, or any other fiber-containing structures.

Also the expression "a polymer substantially made up of ethylene terephthalate units" is meant to define polyethylene terephthalate and copolymers which have in their polymer chains not more than 10 mole percent of units other than the ethylene terephthalate units. For instance, the polymer may be prepared from a reaction mixture which in addition to terephthalic acid or derivatives thereof contains isophthalic acid or other dicarboxylic acid or derivatives thereof. Likewise, the reaction mixture may in addition to ethylene glycol contain one or more other diols such as propylene glycol. These copolymers are fully documented and described in the patent literature. The term "polyethylene terephthalate" used hereinafter for brevity is also to be understood to include such copolymers.

Reinforcing fibers of polyethylene terephthalate are known. These fibers are used, inter alia, for reinforcing rubber articles such as pneumatic tires and conveyor belts, as well as sheet material and layered material having a base of bitumen or asphalt. In these applications the fibers absorb part of the strain acting on the reinforced product. The higher the force which is required to elongate the fibers to a given extent, the smaller will be the deformation at a given force. Products such as automobile tires and road surfaces are subject to varying dynamic forces. The smaller the deformations as a result of these forces, the longer will be the service life, because the creep and fatigue properties of such products are to a high degree negatively influenced by deformation. For these applications it is therefore advantageous to use fibers having a high modulus. It has been found that for the reinforcing of asphalt road surfaces it is not the initial modulus of the fibers which is of decisive importance, but the modulus prevailing at a relatively high load. This modulus should be such that at a load of 5 grams per denier, the stretch or, in other words, elongation is not more than 5%.

Fibers that conform to this requirement are known, inter alia, from the disclosure of the British Pat. Specification No. 848,811.

Although the known polyethylene terephthalate fibers are in many respects very suitable for reinforcing sheet material and layered material having a base of bitumen, these fibers have the following shortcoming. For many applications, it is desirable to use bitumen, or bitumen-containing materials having a high softening point. The application of such a material must be carried out in a liquid or molten state at temperatures up to 160°C. or higher. It has been found that at 160°C. the known polyethylene terephthalate fibers show a relatively high degree of shrinkage, which often gives rise to undue deformation in the reinforced product. For instance, during road construction, when a fabric is provided which is made of a known polyethylene terephthalate fiber and a bitumen coating heated up to about 160°C. or higher is subsequently applied thereto, the fabric will shrink to such a degree that undulations and cracks will be formed in the bitumen coating.

It has been found that this drawback is not encountered when the polyethylene terephthalate fibers satisfy particular demands as to reduced shrinkage at high temperatures. Advantageously the present invention provides a polyethylene terephthalate fiber having a unique combination of properties including low shrinkage at elevated temperatures.

Thus this invention contemplates a reinforcing fiber which comprises a fiber of polyethylene terephthalate that has a tenacity of at least about 7.5 grams per denier, and elongation at break of at least about 9% and an elongation of not more than about 5% at a load of 5 grams per denier and that shrinks less than 4% when kept under a tension of 0.05 grams per denier for 4 minutes at a temperature of about 160°C. (The tenacity and elongation of the fibers are determined at a temperature of 20°C., a relative humidity of 65% and at a constant rate of extension of 30 centimeters per minute).

The fiber of this invention is thus distinct from all known polyester fibers in that it satisfies a combination of requirements regarding tenacity, elongation at break, elongation at a load of 5 grams per denier, and low shrinkage at about 160°C.

Known fibers that show a close resemblance to the fiber of this invention are described in the British Pat. Specification No. 848,811. However, upon heating at 160°C., these known fibers show a shrinkage which is considerably higher than 4%. From FIG. 4 of the patent specification it is evident that upon being heated for a short time at 135°C. the fibers disclosed shrink considerably more than 5%. As may be inferred by extrapolation from the data shown in FIG. 4 of the British Specification, these fibres, heated at 160°C. for 4 minutes, shrink at least 9%. It will be noted that the British Specification also mentions the possibility of pre-shrinking the fibers by subjecting the fibers to a heating treatment in order to reduce the shrinkage during processing. This treatment, however, has a very unfavorable influence on the other properties and the resulting pre-shrunk product no longer meets the combination of requirements as regards tenacity, elongation at break or elongation at a load of 5 grams per denier. This lack of properties is clearly demonstrated by the data illustrated in FIGS. 1, 2 and 3 of the British Patent Specification.

As already mentioned, the fiber of the invention is particularly suitable for reinforcing layered material and sheeted material having a base of bitumen. It is preferred that the fiber should be employed in the form of a continuous multifilament yarn. This yarn may be twisted or non-twisted. Alternatively, if a higher coherency of the filaments is required, use may be made of a tangled yarn. In such case, the filaments have been interlaced by turbulent air streams.

Another aspect of this invention is concerned with a process for producing the unique reinforcing fibers. Thus, the fiber of this invention may be obtained by subjecting an undrawn fiber of polyethylene terephthalate having a relative viscosity of about 1.50 to 1.70 to a two-stage drawing procedure, the drawing in the first stage taking place at a temperature of about 70°C. to 100°C., and at a draw ratio in the range of about 3.8 to 4.2, and the drawing in the second stage taking place in the presence of superheated steam at a temperature of about 210°C. to 250°C. and at such a draw ratio that the total draw ratio is in the range of about 5.6 to 6.0.

By the term "relative viscosity" it is meant the ratio of the rate of flow through a capillary of a 1 percent solution of the polymer in metacresol to the rate of flow of the pure solvent, measured at a temperature of 30°C.

This process makes it possible to obtain fibers of this invention having a tenacity in the range of about 7.5 to 9.5 grams per denier, an elongation at break of about 9 to 15%, an elongation of about 2 to 5% at a load of 5 grams per denier, (determined under the heretofore-described testing conditions) and a shrinkage of about 1 to 4% upon being heated for 4 minutes at about 160°C.

A similar two-stage process for drawing yarn of synthetic polyesters is known and disclosed in U.S. Pat. No. 2,556,295. From the disclosure of this patent it is apparent that the use of different draw ratios and temperatures in each of the drawing stages is known per se. However, this patent does not teach the specific combination of drawing conditions required, including the use of superheated steam to heat the fiber or yarn in the second stage of drawing. Moreover, although this patent mentions that the fibers described therein have a low shrinkage at an elevated temperature, it does not reveal a fiber having the properties of the fiber according to the present invention.

According to the U.S. Pat. No. 2,556,295, the yarns designated as "1 SD" and "3 DD" in Table VIII in column 12, have a particularly low shrinkage at 90°C. (dry) and 100°C. (wet). After these yarns were drawn, they were relaxed and upon being subjected to a load of 5 grams per denier show an elongation which is much higher than the maximum elongation of 5% exhibited by the fiber of the present invention.

It is also noted that upon being heated for 30 minutes at 90°C. the "2 SD" and "4 DD" yarns in Table VIII of this patent show a shrinkage of only 0.52% and 1.3%, respectively. However, it has been found that upon being heated for 4 minutes at 160°C., these yarns show a shrinkage which is considerably higher than 6%.

It should also be realized that the French Patent No. 1,490,211 mentions that when fibers of polyethylene terephthalate having a relative viscosity in the range of 1.60 to 1.75 and a tenacity of 7 to 8 grams per denier are subjected to a heat treatment at 210°C. to 230°C., with their length being kept constant, these fibers may be made into fibers having a shrinkage of about 4% when being heated up to 150°C. without the heat treatment resulting in loss of tenacity or modulus.

It has been found that, although according to the French Patent the heat setting treatment does not result in a loss of modulus, this result does not imply that at a load of 5 grams per denier the elongation of the fiber does not increase. As will be apparent from the following Examples III and IV, a fiber subjected to the proposed heat treatment of the French Patent does not satisfy the demands made on a fiber according to the present invention, because of a load of 5 grams per denier the elongation is higher than the maximum permissible 5%.

The fibers according to the invention are of particular importance as reinforcing material of bituminous road surfaces. However, they also may serve to reinforce other materials. The fibers are particularly suitable for the purpose of reinforcing materials which are subjected to high temperatures as they are being formed in to their desired shape.

Accordingly, this invention also is directed to sheet materials and layered materials which have a base of bitumen and are reinforced with the fibers according to the invention.

The invention will be further understood by reference to the following examples:

EXAMPLE I

A melt of polyethylene terephthalate having a relative viscosity of 1.59 is extruded through a spinnerette provided with 105 orifices measuring 250 $\mu$ in diameter, at a rate of 161 grams per minute and a temperature of 285°C.

The polymer streams issuing from the spinnerette are cooled over a distance of 10 to 150 cm. from the spinnerette by directing a stream of cooling air on to them. The threads are wound at a speed of 500 meters per minute.

After having been provided with a finish, the threads obtained are passed over a drawpin having a temperature of 80°C. and drawn to four times their original length. Subsequently, the threads are passed through a steam box 10 meters long in which the threads are drawn at a temperature of 230°C. and a speed of 150 meters per minute to a total draw ratio of 5.8. The threads obtained in this way is doubled by plying it into a cord having a denier of 1000, a tenacity of 7.8 grams per denier, and elongation at break of 9.7%, a shrinkage of 3.9% after heating for 4 minutes at 160°C., and an elongation of 4.5% at a load of 5 grams per denier.

EXAMPLE II

A melt of polyethylene terephthalate having a relative viscosity of 1.62 is extruded through a spinnerette with 200 orifices measuring 250 $\mu$ in diameter at a rate of 325 grams per minute and a temperature of 290°C.

The polymer steams issuing from the spinnerette are cooled over a distance of 10 to 150 cm. from the spinnerette by directing a stream of cooling air on to them. The threads are wound at a speed of 500 meters per minute.

After having been provided with a usual finish, the threads obtained are passed over a drawpin having a temperature of 80°C. and drawn to four times their original length. Subsequently, the threads are passed through a steam box 10 meters long in which the threads are drawn at a temperature of 210°C. and a speed of 150 meters per minute to a total draw ratio of 5.8. The thread thus made has a denier of 990, a tenacity of 8.15 grams per denier, an elongation at break of 11.0%, a shrinkage of 3.9% after being heated for 4 minutes at 160°C., and an elongation of 4.5% at a load of 5 grams per denier.

EXAMPLE III

In order to establish whether a yarn similar to that of this invention may also be obtained by the process proposed in the French Pat. No. 1,490,211, a single layer of drawn polyethylene terephthalate yarn was wound on a rigid bobbin, which was subsequently heated for 30 minutes in air at 230°C. After this treatment the denier of the yarn had not changed. The following table shows the values of several properties of the yarn before and after the treatment:

| Yarn Properties | Before Heat Treatment | After 30 Minutes Heating at 230°C |
|---|---|---|
| Heat Shrinkage (4 min. at 160°C.) | 8.6% | 0.4% |
| Tenacity | 7.7 g.p.d. | 6.8 g.p.d. |
| Elongation at Break | 10.1% | 12.8% |
| Elongation at a load of 5 grams | 5.0% | 6.3% |
| Initial Modulus | 90.0 g.p.d. | 90.0 g.p.d. |

These results show that although the heat-relaxation does not change the initial modulus, the treatment does cause the tenacity to decrease from 7.7 g.p.d. (grams per denier) to 6.8 g.p.d. and also results in a considerable loss of modulus at a load of 5 grams.

EXAMPLE IV

It was also tried to obtain a yarn similar to that of the invention by heat-relaxing a yarn (i.e. heating the yarn while keeping it at a constant length) having a high heat-shrinkage to form a yarn having a low heat-shrinkage, in accordance with the teachings of the French Pat. No. 1,490,211.

To this end a polyethylene terephthalate yarn having a denier of 1050 was passed through a chamber containing steam at 230°C. The supply rate was equal to the discharge rate. These rates were varied in order to obtain different residence times in the hot steam. The results are listed in the following table.

| Yarn Properties | No Steam Treatment | 2.4 Seconds in Steam of 230°C | 3.2 Seconds in Steam of 230°C | 9.6 Seconds in Steam of 230°C |
|---|---|---|---|---|
| Tenacity, g.p.d. | 7.2 | 7.3 | 7.4 | 7.4 |
| Elongation at Break | 8.8% | 11.3% | 12.4% | 13.6% |
| Heat-Shrinkage 4 min. at 160°C. | 8.1% | 3.5% | 2.5% | 1.5% |
| Elongation at a load of 5 g.p.d. | 4.8% | 5.6% | 5.7% | 6.0% |

In these runs, too, the initial modulus did not change considerably. But, as appears from the date in the above table, the heat-relaxation causes the elongation at a load of 5 g.p.d. to increase, so that products are obtained which do not meet the requirements for a yarn according to the present invention.

It will be understood that a fiber according to the invention may in the usual way be provided with a finish and with a coating of a substance which promotes adhesion to the material to be reinforced. In the preparation of reinforced bitumencontaining structures such as roadways, it has been found that certain adhesive promoting substances are considerably more effective than others. Specifically, it is advantageous to employ adhesive substances comprising resinous materials that have a softening point between 50°C. and 160°C., are miscible with bitumen, and in the molten state act as wetting agents on the reinforcing fiber. Exemplary of the resinous materials that may be used as adhesive promoting substances with the fibers of this invention are montan resin, tall resin, the coumarone and indene resins, maleic resins, phenol resins, rosin derivatives, and the like.

EXAMPLE V

The example illustrates the use of the fibers of this invention to reinforce a bitumen-containing road surface. In construction of the test road, a foundation layer of a mineral mixture of 50% by weight of gravel and filler and 50% by weight sand with asphalt bitumen having a high softening point is applied at a depth of about 7 cm. to a sub-layer of compacted sand. About 5 to 6% by weight of the foundation layer consists of bitumen. This layer is applied at a temperature of about 160°C. and rolled. Thereafter, an adhesive layer of an anionic 50% asphalt emulsion is provided over the foundation layer and a fabric made of the same type of polyethylene terephthalate fiber described in Example I is then rolled out over the adhesive layer. The fabric has a plain weave type and is charged with about 45% by weight of a montan resin having a solidifying point of 75° to 76°C., an acid number between 30 and 40 and a saponification number between 55 and 65.

After the fabric is stretched longitudinally and transversely over the foundation layer and pinned down, a second coating of the asphalt emulsion is applied by spraying and is allowed to break up. Then another asphalt layer having the same composition of gravel, sand, filler and asphalt bitumen as the foundation layer is applied at a temperature of about 160°C. and rolled to a thickness of about 7 cm.

This road surface is compared with one, made in the same manner but using a fabric woven of a polyethylene terephthalate fiber having suitable tenacity and elongation properties, (but a shrinkage greater than 4% at 160°C., i.e. 8%) and coated with a non-resinous adhesive promoting substance, i.e. solar oil. The comparison shows that the road surface containing the fiber of this invention has substantially no deformation caused by shrinkage of the fabric and that there is excellent adhesion between the reinforcing fabric and the bitumen layer; whereas the other road surface has cracks and undulations formed by the deformation of the bitumen-containing layer during shrinkage of the fabric and the fabric poorly adheres to the bitumen layer.

What is claimed is:

1. A process for producing a reinforcing fiber of polyethylene terephthalate which comprises drawing a non-drawn fiber of polyethylene terephthalate in two stages, the polyethylene terephthalate having a relative viscosity of from 1.50 to 1.70, the drawing in the first stage being effected at a temperature in the range of about 70°C. to about 100°C. at a draw ratio of from about 3.8 to 4.2, and the drawing in the second stage being effected in the presence of superheated steam at a temperature of from about 210°C. to 250°C. and at a draw ratio such that the total draw ratio in the two stages is in the range of from about 5.6 to 6.0; said fiber of polyethylene terephthalate having a tenacity of at least about 7.5 grams per denier, an elongation at break of at least about 9%, an elongation of not more than about 5% under a load of 5 grams per denier and a shrinkage of less than 4% when kept under a tension of 0.05 grams per denier for 4 minutes at about 160°C.

2. The process of claim 1, in which the fiber of polyethylene terephthalate is formed from a melt of polyethylene terephthalate having a relative viscosity of 1.59 by extrusion through a spinnerette at a temperature of 285°C., the fiber of polyethylene terephthalate is passed over a drawpin having a temperature of 80°C., and is drawn to four times its original length in the first stage and subsequently, in the second stage, the fiber is passed through a steam box in which the fiber is drawn at a temperature of 230°C. to a total draw ratio of 5.8.

3. The process of claim 1, in which the fiber of polyethylene terephthalate is formed from a melt of polyethylene terephthalate having a relative viscosity of 1.62 by extrusion through a spinnerette at a temperature of 290°C., the fiber of polyethylene terephthalate is passed over a drawpin having a temperature of 80°C., and is drawn to four times its original length in the first stage and subsequently, in the second stage, the fiber is passed through a steam box in which the fiber is drawn at a temperature of 210°C. to a total draw ratio of 5.8.

* * * * *